US012173981B2

(12) United States Patent
Schoonmaker et al.

(10) Patent No.: US 12,173,981 B2
(45) Date of Patent: Dec. 24, 2024

(54) LAUNCHING SYSTEM FOR AN AIR GUN

(71) Applicant: Moab Ventures LLC, Gravette, AR (US)

(72) Inventors: Geoffrey Schoonmaker, Rolla, MO (US); Joshua Matthew Isabell, Gravette, AR (US); Jacob Wagner, Centerton, AR (US)

(73) Assignee: Moab Ventures LLC, Gravette, AR (US)

( * ) Notice: Subject to any disclaimer, the term of this patent is extended or adjusted under 35 U.S.C. 154(b) by 165 days.

(21) Appl. No.: 18/045,266

(22) Filed: Oct. 10, 2022

(65) Prior Publication Data

US 2023/0115688 A1 Apr. 13, 2023

Related U.S. Application Data

(60) Provisional application No. 63/262,461, filed on Oct. 13, 2021.

(51) Int. Cl.
*F41B 11/00* (2013.01)
*F41B 11/642* (2013.01)
*F41B 11/70* (2013.01)

(52) U.S. Cl.
CPC ..... *F41B 11/642* (2013.01); *F41B 11/70* (2013.01)

(58) Field of Classification Search
CPC ..... F41B 11/642; F41B 11/71; F41B 11/70; F41B 11/723; F41B 11/57; F41B 11/646;
(Continued)

(56) References Cited

U.S. PATENT DOCUMENTS 878,560 A 2/1908 Polley
2,357,951 A * 9/1944 Hale ..... F41B 11/68 89/33.14

(Continued)

FOREIGN PATENT DOCUMENTS

AU 2014203433 7/2014
CN 208155146 U 11/2018

(Continued)

OTHER PUBLICATIONS

Gully, et al., A Feasibility Study of a Hypersonic Real-Gas Facility, NASA Langley Research Center, Grant #NAG1-721 1987.

(Continued)

*Primary Examiner* — Michael D David
(74) *Attorney, Agent, or Firm* — Heslin Rothenberg Farley & Mesiti, P.C.

(57) ABSTRACT

A launching system for an air gun includes a compression cylinder. The compression cylinder includes a cylinder body having an open rearward end and a closed forward end with an interior bore therebetween. The forward end has a transfer port configured for fluid communication with a barrel of an air gun. The piston includes a piston body. The piston body has a forward portion disposed within the interior bore. A sealing device is disposed on the forward portion of the piston body. One of a ferromagnetic section or magnet is disposed on a rearward portion of the piston body. A drive coil assembly is disposed over the one of a ferromagnetic section or magnet. When the drive coil assembly is energized with a first polarity, the piston is drawn from a reset position to a firing position relative to the compression cylinder by the drive coil assembly with increasing force.

17 Claims, 11 Drawing Sheets

(58) Field of Classification Search
CPC ..... F41B 11/64; F41B 11/721; F41B 11/73; F41B 11/54; F41B 11/62
USPC ..... 124/67, 73, 65, 66, 76, 77, 72, 37, 75
See application file for complete search history.

(56) References Cited

U.S. PATENT DOCUMENTS 2,528,495 A * 11/1950 Carter ..... F41B 11/642 124/39
2,568,432 A * 9/1951 Cook ..... F41B 11/71 124/32
2,572,176 A * 10/1951 Mihalyi ..... F41B 11/55 124/40
2,594,240 A * 4/1952 Wells ..... F41B 11/723 137/505.11
2,601,033 A * 6/1952 Lawrence ..... F41B 11/642 124/67
2,604,088 A * 7/1952 Wells ..... F41B 11/723 124/67
2,630,795 A * 3/1953 Peters ..... F41B 11/642 124/67
2,977,951 A * 4/1961 Cavin ..... F41B 11/642 124/67
3,111,121 A * 11/1963 Baggott ..... F41B 11/642 124/52
3,212,490 A * 10/1965 Merz ..... F41B 11/642 89/7
3,523,538 A * 8/1970 Kunio ..... F41H 13/0025 607/116
3,612,379 A * 10/1971 Panock ..... B27F 7/34 227/8
3,951,038 A * 4/1976 Van Langenhoven .... B25C 1/12 124/67
4,369,759 A * 1/1983 Gerstenberger ..... F41A 3/78 124/68
4,709,686 A 12/1987 Taylor et al.
4,757,629 A 7/1988 Austin
4,770,153 A * 9/1988 Edelman ..... F41B 11/724 137/505.22
4,899,717 A 2/1990 Rutten et al.
4,923,182 A * 5/1990 Resuggan ..... F41B 11/642 124/67
5,477,843 A * 12/1995 Kunimoto ..... F41B 11/56 124/75
5,531,210 A * 7/1996 Meiser ..... F41B 11/642 124/66
5,570,676 A * 11/1996 Gore ..... F41B 11/642 124/66
5,590,696 A * 1/1997 Phillips ..... F17C 7/00 222/3
5,599,302 A * 2/1997 Lilley ..... F41B 11/81 604/500
5,724,955 A * 3/1998 Johnson ..... F41B 11/57 124/53.5
6,158,424 A * 12/2000 Kunimoto ..... F41B 11/62 124/73
6,364,162 B1 * 4/2002 Johnson ..... F41B 11/54 222/61
6,857,422 B2 2/2005 Pedicini et al.
6,901,689 B1 * 6/2005 Bergstrom ..... F41A 3/92 42/1.06
6,973,748 B2 * 12/2005 Rice ..... F41B 11/00 124/31
7,886,731 B2 * 2/2011 Masse ..... F41B 11/721 124/73
7,984,708 B2 7/2011 Pedicini et al.
8,132,563 B2 * 3/2012 Gore ..... F41B 11/645 124/65
8,322,329 B1 * 12/2012 Sikes ..... F41B 11/723 124/73
8,413,644 B2 4/2013 Masse
8,567,380 B2 * 10/2013 Nugent ..... F41B 11/646 124/64
8,624,448 B2 1/2014 Kaiser et al.
9,157,695 B1 * 10/2015 Gore ..... F41B 11/642
9,399,991 B2 7/2016 Dainez et al.
9,638,490 B1 * 5/2017 Shen ..... F41B 11/723
9,797,678 B2 10/2017 Tseng
10,391,520 B2 8/2019 McIlwrath et al.
10,663,251 B2 5/2020 Lemarquand
10,955,215 B2 3/2021 Witzigreuter et al.
10,955,216 B2 3/2021 Pedicini
2002/0178901 A1 * 12/2002 Bergstrom ..... F41A 25/20 89/198
2003/0168052 A1 * 9/2003 Masse ..... F41B 11/57 124/73
2004/0065310 A1 * 4/2004 Masse ..... F41B 11/71 124/75
2004/0089280 A1 * 5/2004 Kunimoto ..... F41B 11/723 124/76
2004/0237954 A1 * 12/2004 Styles ..... F41A 19/58 124/77
2008/0155875 A1 * 7/2008 Iwasawa ..... F41B 11/644 42/54
2009/0059718 A1 * 3/2009 Tessien ..... B01J 19/008 366/267
2009/0241931 A1 * 10/2009 Masse ..... F41B 11/71 124/76
2015/0354918 A1 * 12/2015 Gore ..... F41B 11/642 124/66
2017/0160046 A1 * 6/2017 Shen ..... F41B 11/642
2017/0299322 A1 * 10/2017 Lort ..... F41B 11/62
2018/0051958 A1 * 2/2018 Iwasawa ..... F41B 11/70
2018/0112948 A1 * 4/2018 Iwasawa ..... F41B 11/643
2018/0120050 A1 * 5/2018 Iwasawa ..... F41B 11/646
2018/0149445 A1 * 5/2018 Lamboy ..... F41B 11/54
2018/0180376 A1 * 6/2018 Lamboy ..... F41B 11/54
2018/0264356 A1 9/2018 Miller
2019/0195594 A1 * 6/2019 Lamboy ..... F41B 11/647
2020/0378717 A1 * 12/2020 Gore ..... F41B 11/642
2021/0381798 A1 * 12/2021 Witzigreuter ..... F41B 11/71
2023/0115688 A1 * 4/2023 Schoonmaker ..... F41B 11/64 124/66
2023/0296349 A1 * 9/2023 St. Phillips ..... F41B 11/646 124/66

FOREIGN PATENT DOCUMENTS

CN 109211001 1/2019
CN 104335003 2/2020
DE 19955234 5/2001
JP H0610600 2/1994
KR 101677586 11/2016
KR 102082682 4/2020
RO 129897 A2 11/2014

OTHER PUBLICATIONS

International Search Report and Written Opinion for PCT/US 22/77886 completed Jan. 23, 2023, 40 pgs.

* cited by examiner

LAUNCHING SYSTEM FOR AN AIR GUN

CROSS REFERENCE TO RELATED APPLICATIONS

This application is a non-provisional of, and claims the benefit of the filing date of, U.S. provisional application 63/262,461, filed Oct. 13, 2021, entitled, "LAUNCHING SYSTEM FOR AN AIR GUN," the contents of which are incorporated herein by reference.

TECHNICAL FIELD

The present disclosure relates to launching/firing systems for guns. More specifically, the disclosure relates to launching systems for air guns.

BACKGROUND

Prior art launching (or firing) systems for air guns commonly utilize electric motors and gearing to control the operation of a piston, which fires a projectile (or shot) from the barrel of the air gun. A gear catches the piston, driving it rearward and compressing a spring, such as a metal spring or an air spring. Once the spring is fully compressed, the piston can be released to compress the air in front of it and fire the shot. This arrangement has many drawbacks, such as excessive high RPM motor and gear noise, teeth breaking off gears, spring fatigue, and complexity.

Additionally, there are unavoidable heat losses due to first compressing a spring, then storing the spring energy for a period of time, then later releasing the spring to fire the shot. These heat losses add inefficiency and reduce firing velocity of the projectile for contemporary air gun launching systems.

Moreover, when a compressed spring of a prior art launching system is released, the force the spring exerts on the projectile will decrease as the spring extends in length. In some cases, the force the spring may exert on a projectile may decrease with the square of the difference of length of the spring.

Accordingly, there is a need for a launching system for an air gun that minimizes the use of electric motors and gears. Further there is a need for a launching system that does not store spring energy or compressed air energy prior to firing a shot. Additionally, there is a need for a launching system for an air gun that increases the force it applies on a projectile, as the projectile is launched.

BRIEF DESCRIPTION

The present disclosure offers advantages and alternatives over the prior art by providing a launching system for an air gun that does not store spring or compressed air energy. Rather the launch system launches a projectile from a barrel by a magnetically driven piston that is disposed in a cylinder. The movement of the piston within the cylinder compresses, but does not store, air in front of the moving piston. The compressed air is forced into the barrel from the cylinder and forces the projectile out of the barrel. Further, the force exerted on the piston increases as the piston moves from a reset position to a firing position. Additionally, there may be no electric motor or gears to provide unwanted high speed noise and/or broken gears.

A launching system for an air gun in accordance with one or more aspects of the present disclosure includes a compression cylinder, a piston and a drive coil assembly. The compression cylinder includes a cylinder body having an open rearward end and a closed forward end with an interior bore therebetween. The forward end has a transfer port configured for fluid communication with a barrel of an air gun. The piston includes a piston body, a sealing device and one of a ferromagnetic section or a magnet. The piston body has a forward portion disposed within the interior bore. The sealing device is disposed on the forward portion of the piston body. The one of a ferromagnetic section or magnet is disposed on a rearward portion of the piston body. The drive coil assembly is disposed over the one of a ferromagnetic section or magnet. When the drive coil assembly is energized with a first polarity, the piston is drawn from a reset position to a firing position relative to the compression cylinder by the drive coil assembly with increasing force.

Another launching system for an air gun in accordance with one or more aspects of the present disclosure includes a compression cylinder, a piston and a magnet. The compression cylinder includes a cylinder body having an open rearward end and a closed forward end with an interior bore therebetween, the forward end having a transfer port configured for fluid communication with a barrel of an air gun. The piston includes a piston body having a forward portion disposed within the interior bore. A sealing device is disposed on the forward portion of the piston body. A permanent magnet is disposed on a rearward portion of the piston body. A drive coil assembly is disposed over the permanent magnet. When the drive coil assembly is energized with a first polarity, the piston is drawn from a reset position to a firing position relative to the compression cylinder by the drive coil assembly with increasing force.

Another launching system for an air gun in accordance with one or more aspects of the present disclosure includes a compression cylinder, a piston and a drive coil assembly. The compression cylinder includes a cylinder body having an open rearward end and a closed forward end with an interior bore therebetween. The forward end has a transfer port configured for fluid communication with a barrel of an air gun. The piston includes a generally U-shaped piston body having a forward portion that is substantially parallel to a rearward portion. The forward portion is disposed within the interior bore. A sealing device is disposed on the forward portion of the piston body. A ferromagnetic section is disposed on the rearward portion of the piston body. A drive coil assembly is disposed over the ferromagnetic section. When the drive coil assembly is energized with a first polarity, the piston is drawn from a reset position to a firing position relative to the compression cylinder by the drive coil assembly with increasing force.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DRAWINGS

The disclosure will be more fully understood from the following detailed description taken in conjunction with the accompanying drawings, in which.

Figure 8:
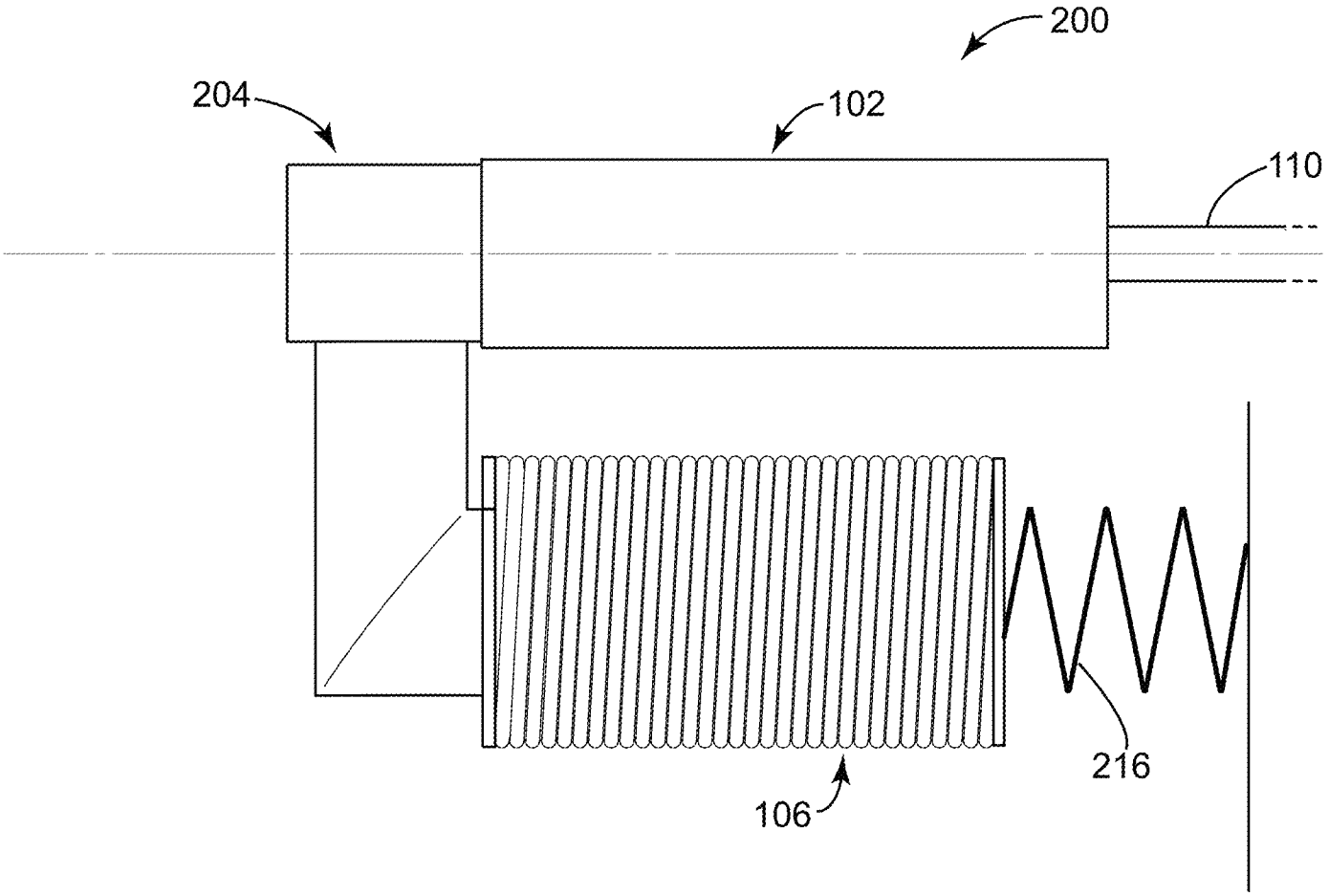
FIG. 8 depicts an example of a side view of another assembly of a launching system for an air gun, according to aspects described herein.
Figure 10:
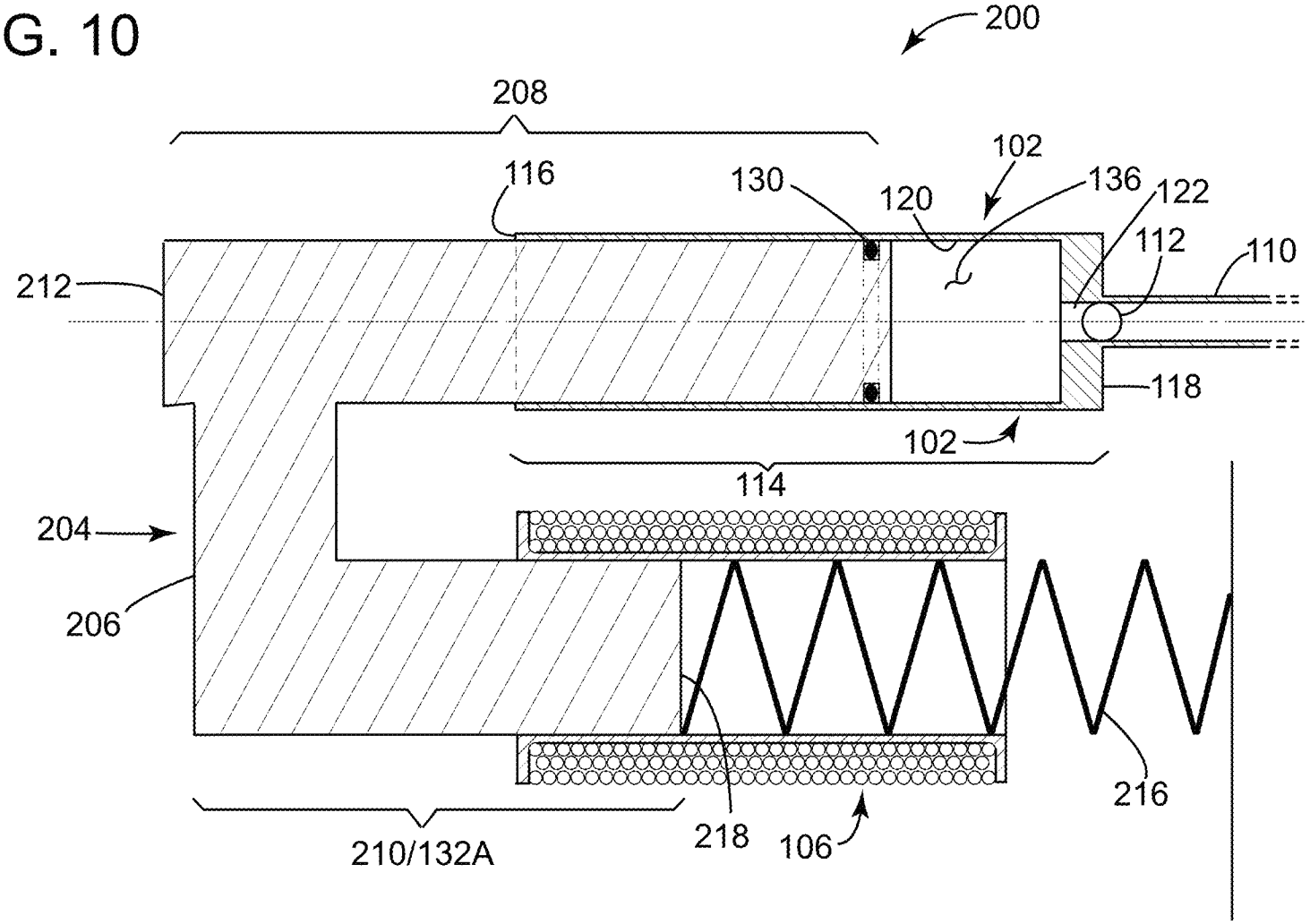
Figure 11:
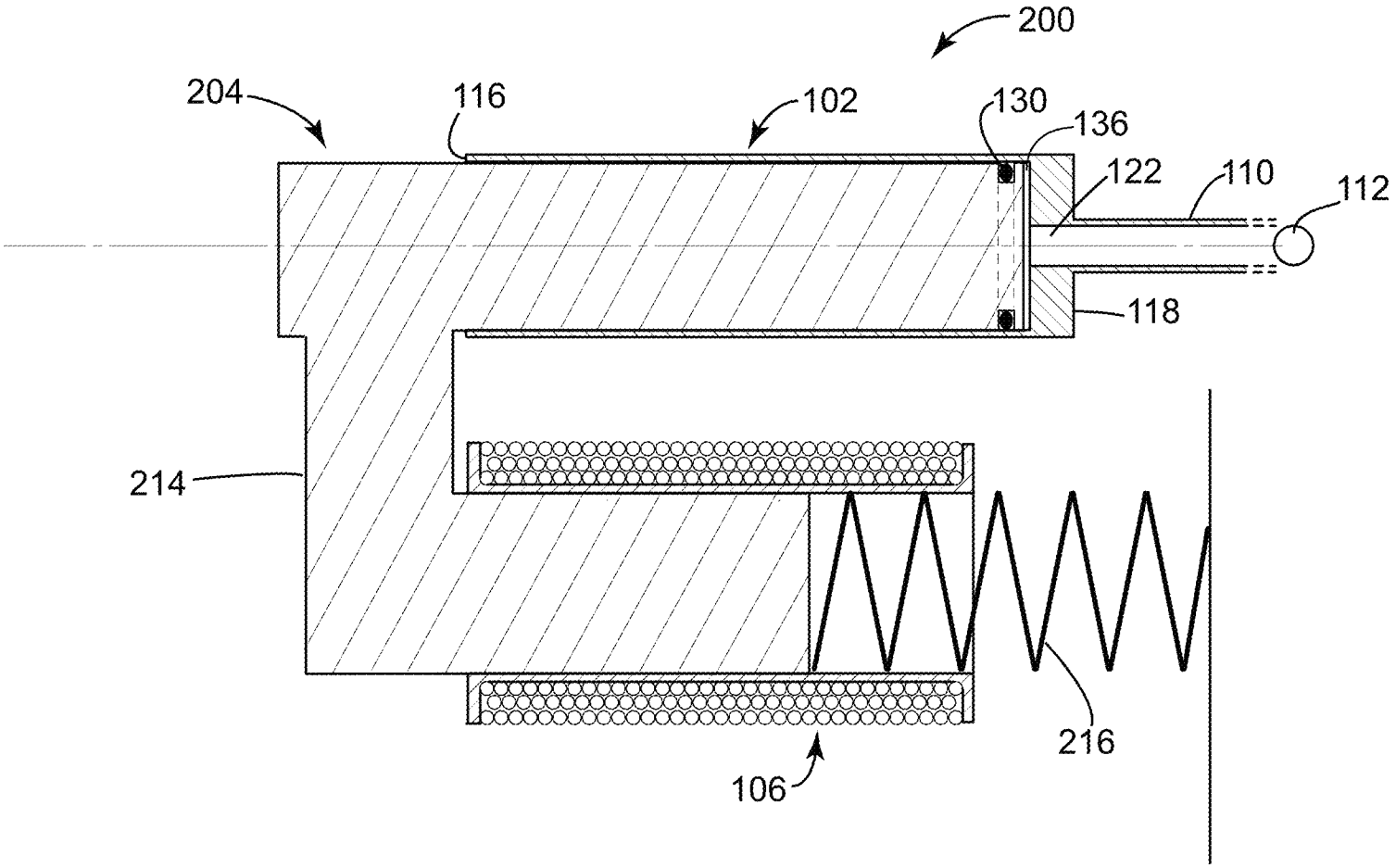

FIG. 10 depicts an example of a cross-sectional side view of a U-shaped piston of the launching system of FIG. 8, wherein the piston is in its reset position, according to aspects described herein; and FIG. 11 depicts an example of a cross-sectional side view of the U-shaped piston of the launching system of FIG. 8, wherein the piston is in its firing position, according to aspects described herein.

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example may be combined with the features of other examples. Such modifications and variations are intended to be included within the scope of the present disclosure.

The terms "significantly", "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 1:
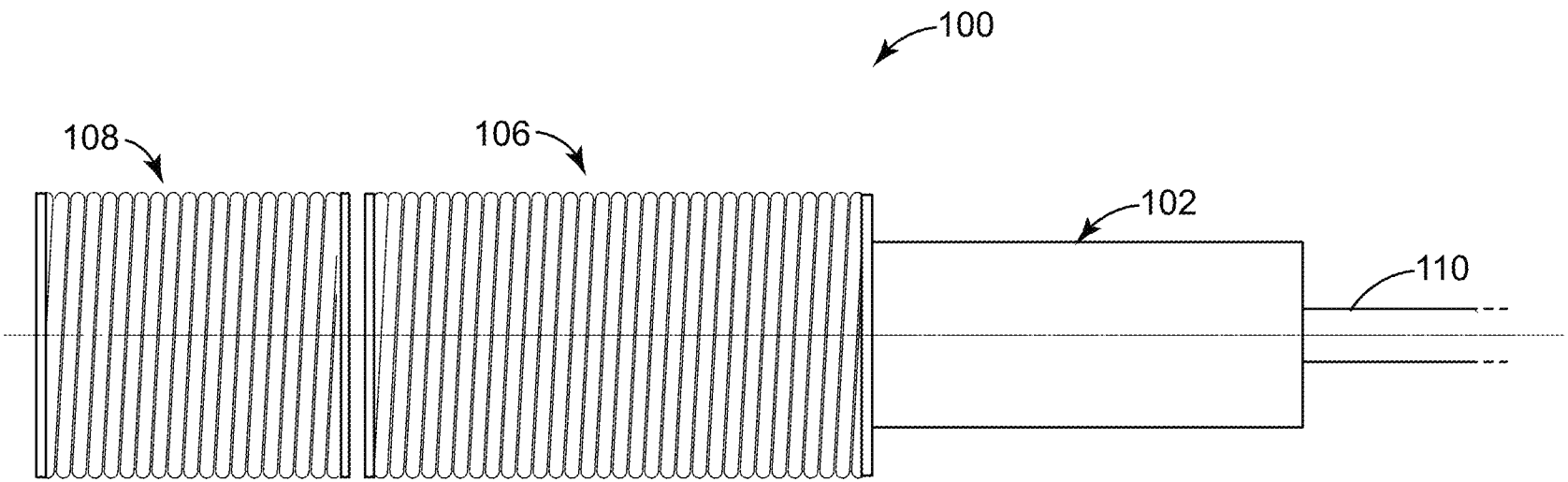
FIG. 1 depicts an example of a side view of an assembly of a launching system for an air gun, according to aspects described herein.
Figure 2:
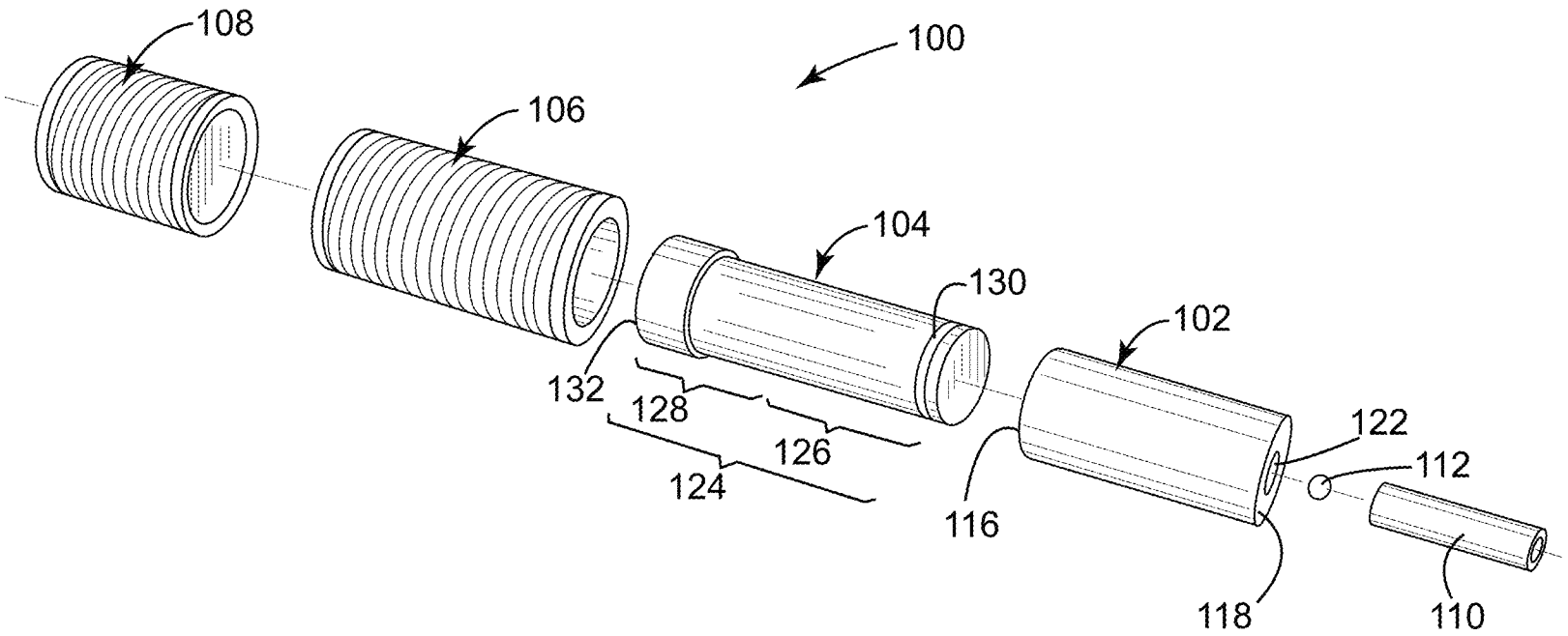
FIG. 2 depicts an example of an exploded perspective view of the launching system of FIG. 1, according to aspects described herein.

Referring to FIGS. 1 and 2, an example is depicted of a side view (FIG. 1) and an exploded perspective view (FIG. 2) of an assembly of a launching system 100 for an air gun, according to aspects described herein. The launching system 100 includes a compression cylinder 102, a piston 104, a drive coil assembly 106 and a reset-push coil assembly 108. As will be explained in greater detail herein, the launching system 100 interfaces with, and is in fluid communication with, a gun barrel 110 and the ammunition (or projectile) 112 inserted in the gun barrel 110.

Figure 3:
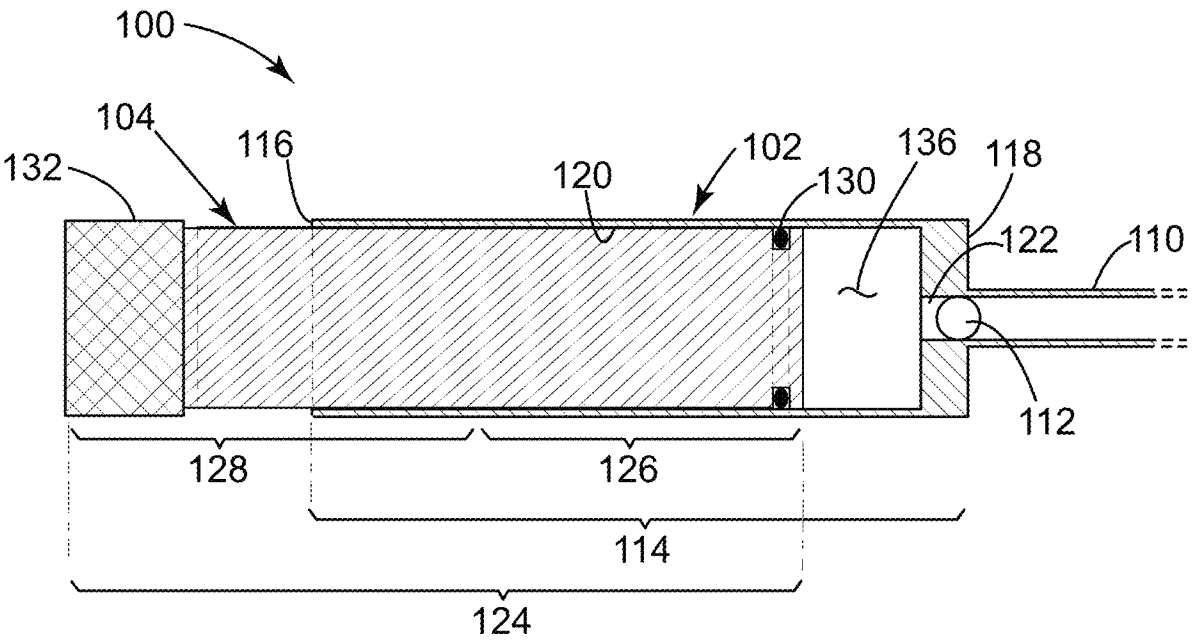
FIG. 3 depicts an example of a cross-sectional side view of a piston within a compression cylinder of the launching system of FIG. 1, according to aspects described herein.

Referring to FIG. 3, an example is depicted of a cross-sectional side view of the piston 104 within the compression cylinder 102 of the launching system of FIG. 1, according to aspects described herein. The compression cylinder 102 includes a cylindrical body 114 having an open rearward end 116 and a closed forward end 118 with an interior bore 120 therebetween. The bore 120 is sized to receive the piston 104 therein. The forward end 118 includes a transfer port 122 that is configured for fluid communication with the barrel 110 of the air gun. In other words, the transfer port 122 extends entirely through the closed forward end 118 such that air may flow from the barrel 110 of the air gun to the interior bore 120 of the compression cylinder 102 and vice versa. The compression cylinder 102 may be composed of a non-ferrous metal, such as aluminum or copper, to reduce the amount of reluctance that may be introduced during operation of the launching system 100.

The system 100 is designed to interface with existing systems of loading. That is, everything ahead of (or forward of) the compression cylinder 102 is standardized parts. So, for example, the barrel 110 of the air gun, the ammunition 112 of the air gun and all other air gun components that are forward of the compression cylinder 102 may be standardized parts. The ammunition may be, for example, BBs or pellets (such as airsoft plastic pellets).

The piston 104 includes a piston body 124 having a forward portion 126 and a rearward portion 128. All or part of the forward portion 126 of piston body 124 may be disposed within the interior bore 120 of the compression cylinder 102. A sealing device 130 is disposed on the forward portion 126 of the piston body 124 proximate the distal end of the forward portion 126. The sealing device may be an O-ring seal, a parachute seal or the like, which is operable to provide an slidable air seal between the bore 120 of the compression cylinder 102 and the piston body 124 of the piston 104.

The piston 104 also includes one of a ferromagnetic section or a magnet 132 that is disposed on the rearward portion 128 of the piston body 124. The one of a ferromagnetic section or a magnet 132 may be disposed on or proximate the distal end of the rearward portion 128 of the piston body 124.

The one of a ferromagnetic section or a magnet 132 may be either a ferromagnetic section 132A or a magnet 132B. If it is a ferromagnetic section 132A, then that section 132A may be composed of such ferromagnetic material as iron or steel.

If the one of a ferromagnetic section or a magnet 132 is a magnet 132B, then that magnet 132B may be an electromagnet 132A that is commutated. That is the electromagnet 132B, may include a series of metal bars or segments that are insulated from each other and can provide a sliding connection to a magnetizing current source as the piston 104 moves.

Also, if the one of a ferromagnetic section or a magnet 132 is a magnet 132B, that that magnet 123B may be a permanent magnet 132B. More specifically, the magnet 132B may be a rare earth magnet, such as a neodymium magnet or a samarium-cobalt magnet.

Figure 4:
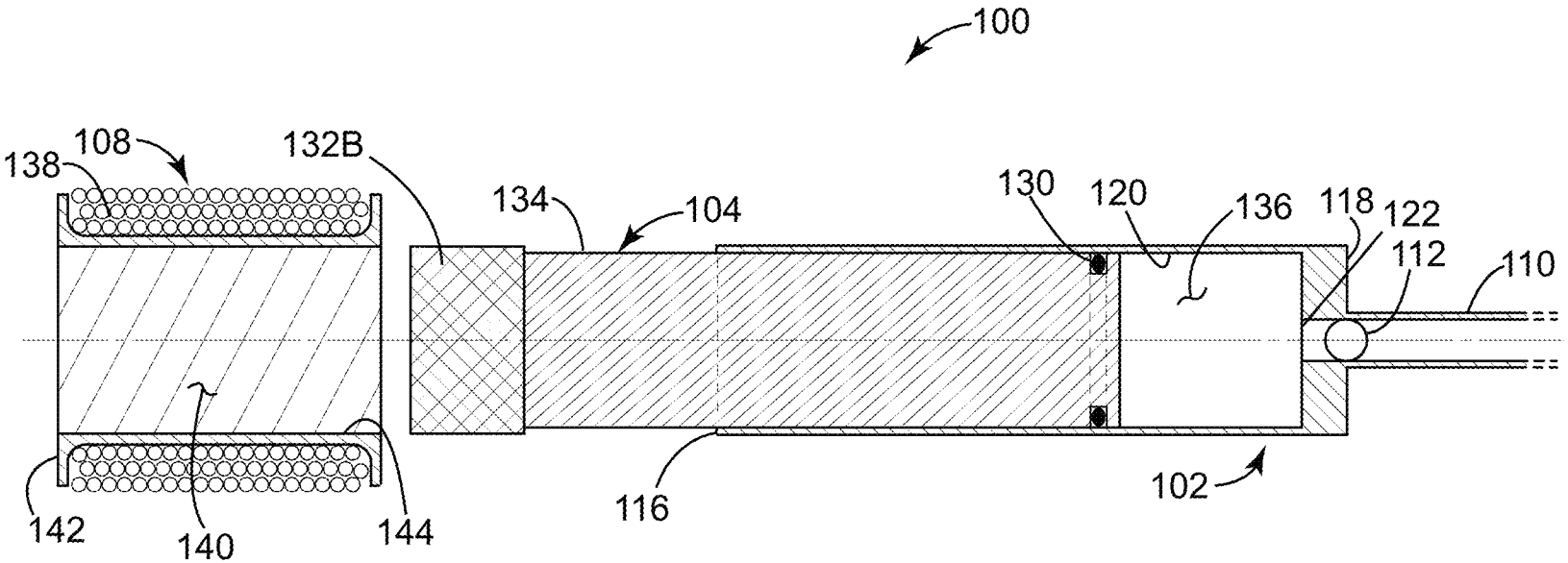
FIG. 4 depicts an example of a cross-sectional side view of a reset-push coil assembly of the launching system of FIG. 1, having drawn the piston into a reset position relative to the compression cylinder, according to aspects described herein.

Referring to FIG. 4, an example is depicted of a cross-sectional side view of the reset-push coil assembly 108 of the launching system 100 of FIG. 1, according to aspects described herein. In the example illustrated in FIG. 4, the one of a ferromagnetic section or magnet 132 is a permanent magnet 132B and the reset-push coil assembly 108 has been energized to attract the permanent magnet 132B and draw the piston 104 from a firing position 135 (see FIG. 5) into a reset position 134 relative to the compression cylinder 102.

The reset-push coil assembly 108 is disposed proximate the permanent magnet 132B, when the piston 104 is in the reset position 134. The reset-push coil assembly 108 includes an outer wire coil 138 (such as copper wire or aluminum wire) that is wound over an inner ferromagnetic core 140. The ferromagnetic core 140 may be composed of various ferromagnetic materials, such as iron or steel. Additionally, the outer wire coil 138 may be wound directly over a spool 142. The spool 142 of the reset-push coil assembly 108 may have a spool bore 144 that is sized to receive the ferromagnetic core 140 therethrough.

When the reset-push coil assembly 108 is energized with a first polarity, the permanent magnet 132B is attracted to the reset-push coil assembly 108 and the piston 104 is drawn from the firing position 135 to the reset position 134. By drawing the piston 104 back into the reset position 134, air 136 is drawn into the bore 120 of the compression cylinder 102 through the gun barrel 110 and the transfer port 132.

Figure 5:
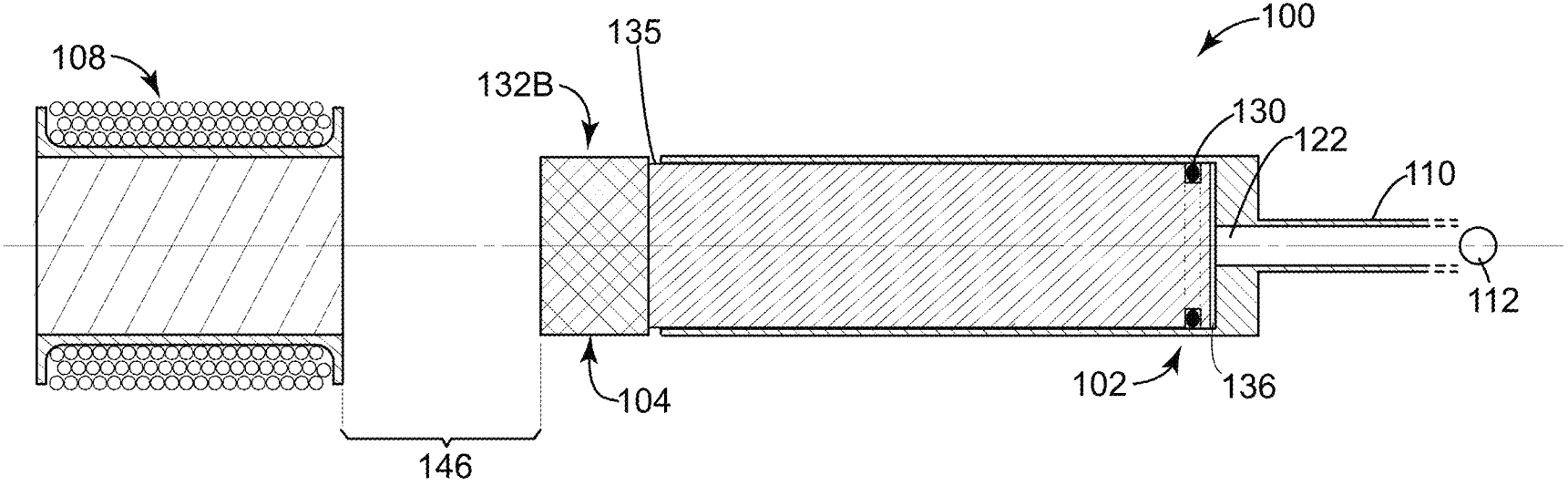
FIG. 5 depicts an example of a cross-sectional side view of the reset-push coil assembly of the launching system of FIG. 1, having driven the piston into a firing position relative to the compression cylinder, according to aspects described herein.

Referring to FIG. 5, an example is depicted of a cross-sectional side view of the reset-push coil assembly 108 of the launching system 100 of FIG. 1, having driven the piston 104 into the firing position 135 relative to the compression cylinder 102, according to aspects described herein. When the reset-push coil assembly 108 is energized with a second polarity, the permanent magnet 132B is repelled from the reset-push coil assembly 108 and the piston 104 is driven from the reset position 134 to the firing position 135 with a force that decreases as the distance 146 between the reset-push coil assembly 108 and permanent magnet 132B increases.

As the piston 104 is driven forward, it compresses the air 136 and builds up air pressure. Once the air pressure overcomes the frictional forces of the barrel 110 on the projectile 112 and also overcomes the inertia of the projectile (ammunition), the projectile 112 may be fired (i.e., launched) through the barrel 110 of the air gun.

Figure 6:
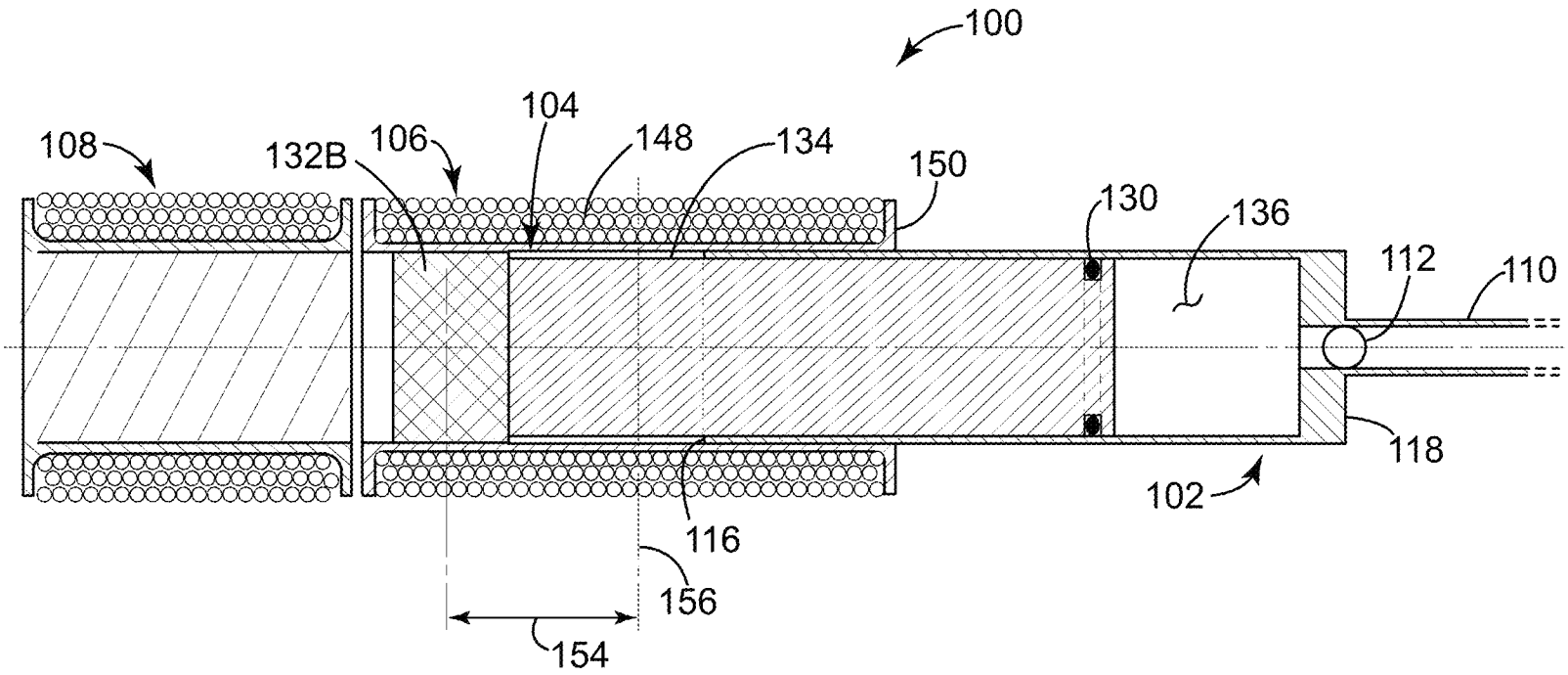
FIG. 6 depicts an example of a cross-sectional side view of a drive coil assembly and the reset-push coil assembly of the launching system of FIG. 1, having drawn the piston into its reset position, according to aspects described herein.
Figure 7:
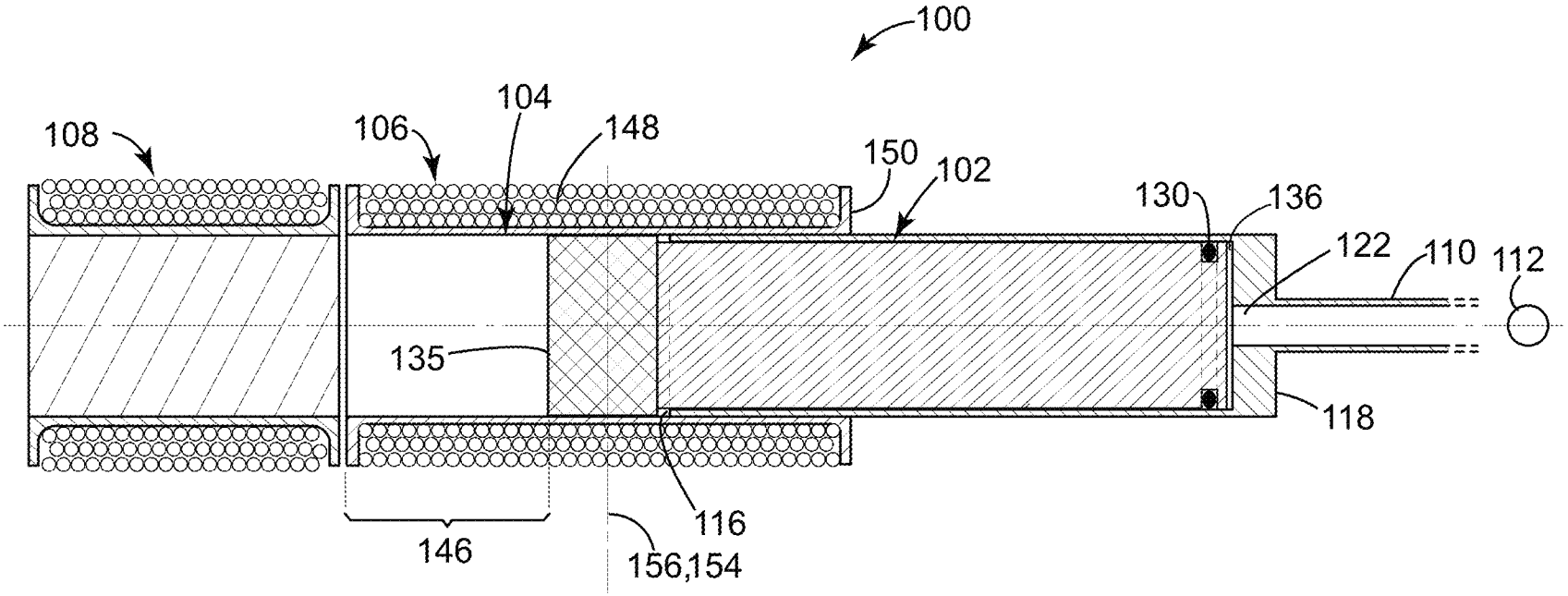
FIG. 7 depicts an example of a cross-sectional view of the drive coil assembly and the reset-push coil assembly of the launching system of FIG. 1, having driven the piston into its firing position, according to aspects described herein.

Referring to FIGS. 6 and 7, an example is depicted of a cross-sectional side view of the drive coil assembly 106 and the reset-push coil assembly 108 of the launching system 100 of FIG. 1, wherein the piston is in the reset position 134 (FIG. 6) and the piston is in the firing position (FIG. 7), according to aspects described herein.

The drive coil assembly 106 includes an outer wire coil 148 (such as copper or aluminum wire) that is wound around a drive coil spool 150. The drive coil spool 150 includes a spool bore 152 that is sized to slidably receive the piston 104 therethrough. The spool 150 may be composed of a plastic or other non-magnetic material to reduce magnetic reluctance that could be introduced during operation of the launching system 100. Even non-ferrous metals, such as aluminum or copper may introduce an undesirable amount of reluctance into the system 100 during operation.

The drive coil assembly 106 may be a single stage coil or multiple stage coil. The multiple stage coil may be utilized for such purposes as to increase the power output of the launching system 100.

During operation, the reset-push coil assembly 108 may be energized with it second polarity and the drive coil assembly 106 may be simultaneously energized with its first polarity. As such, the permanent magnet 132B is repelled from the reset-push coil assembly 108 and the piston 104 is driven from the reset position 134 (FIG. 6) to the firing position 135 (see FIG. 7) with a force provided by the reset-push coil assembly 108 that decreases as the distance 146 between the reset-push coil assembly 108 and permanent magnet 132B increases. Additionally, the permanent magnet 132B is simultaneously drawn toward the center 156 of the drive coil assembly 106 and the piston 104 is drawn from the reset position 134 to the firing position 135 with a force provided by the drive coil assembly 106 that increases as the distance 154 between the center 156 of the drive coil assembly 106 and the permanent magnet 132B decreases.

Advantageously, the drive coil assembly 106 and the reset-push coil assembly 108 provide a two stage thrust on the piston 104. That is, the reset-push coil assembly's 108 initially applied force on the piston 104 is the strongest at the reset position 134, while the drive coil assembly's 106 initially applied force on the piston 104 is weakest at the reset position 134. However, as the piston 104 is driven toward its firing position 135, the force applied by the drive coil assembly 106 increases while the force applied by the reset-push coil assembly decreases. As the piston 104 is driven forward in the compression cylinder 104, the air 136 is compressed. Once the air pressure overcomes the frictional forces between the barrel 110 and projectile 112, and overcomes the inertia of the projectile 112, the projectile 112 will launch.

This unique combination of forces applied by the reset-push coil assembly 108 and drive coil assembly 106 of launching system 100 advantageously enables a greater average force to be applied to driving the piston 104 forward from reset position 134 to firing position 135 than prior art launching systems. Additionally, because there is no storage of compression energy (such as when a metal spring or air spring is compressed and held for a fixed period of time), there is less heat loss associated with the launching system 100 compared to prior art launching system and, therefore, the launching system 100 is inherently more efficient than prior art launching systems.

Once the projectile has been launched, the reset-push coil assembly 108 may be energized with its first polarity and the drive coil assembly 106 may be simultaneously deenergized. Accordingly, the permanent magnet 132B is attracted to the reset-push coil assembly 108 and the piston 10 is drawn from the firing position 135 to the reset position 134. The drive coil assembly 106 may provide substantially zero force upon the permanent magnet 132B as the piston 104 is drawn from the firing position 135 to the reset position 134.

Figure 9:
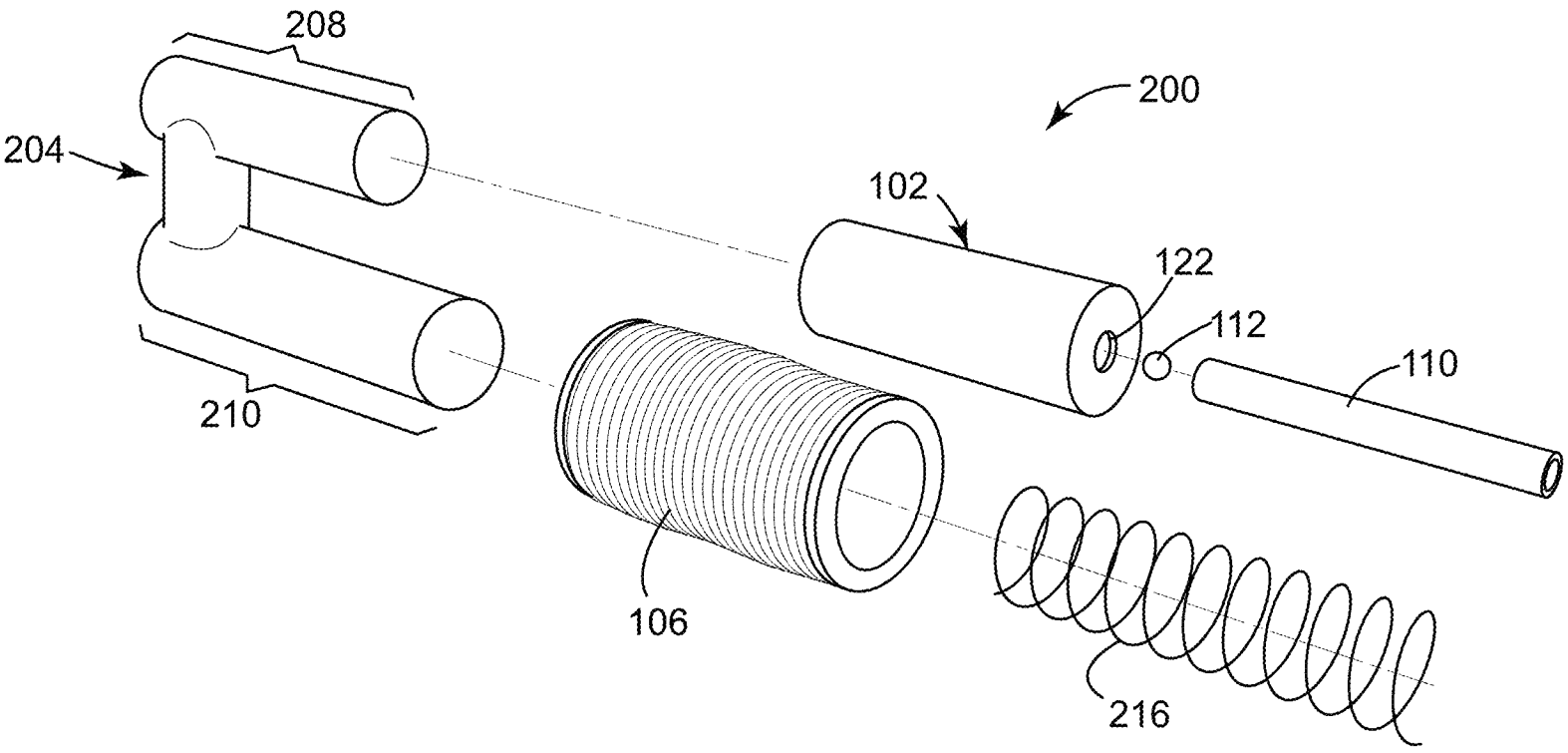
FIG. 9 depicts an example of an exploded perspective view of the launching system of FIG. 8, according to aspects described herein.

Referring to FIGS. 8 and 9, an example is depicted of a side view (FIG. 8) and an exploded view (FIG. 9) of another assembly of a launching system 200 for an air gun, according to aspects described herein. Launching system 200 includes many of the same or similar parts as that of launching system 100 and, therefore, those same or similar parts will be referred to herein with the same reference numbers used to illustrate launching system 100. The launching system 200 includes a compression cylinder 102, a piston 204 and a drive coil assembly 106. As will be explained in greater detail herein, the launching system 200 interfaces with, and is in fluid communication with, a gun barrel 110 and the ammunition (or projectile) 112 inserted in the gun barrel 110.

Referring to FIGS. 10 and 11 an example is depicted of a cross-sectional side view of a U-shaped piston 204 of the launching system 200 of FIG. 8, wherein the piston 204 is in a reset position 212 (FIG. 10) and in its firing position 214 (FIG. 11) relative to the compression cylinder 102, according to aspects described herein.

The launching system 200 includes a compression cylinder 102, a generally U-shaped piston 104 and a drive coil assembly 106. The compression cylinder 102 includes a cylindrical body 114 having an open rearward end 116 and a closed forward end 118 with an interior bore 120 therebetween. The bore 120 is sized to receive the piston 104 therein. The forward end 118 includes a transfer port 122 that is configured for fluid communication with the barrel 110 of the air gun. In other words, the transfer port 122 extends entirely through the closed forward end 118 such that air may flow from the barrel 110 of the air gun to the interior bore 120 of the compression cylinder 102 and vice versa. The compression cylinder 102 may be composed of a non-ferrous metal, such as aluminum or copper, to reduce the amount of reluctance that may be introduced during operation of the launching system 100.

The system 200 is designed to interface with existing systems of loading. That is, everything ahead of (or forward of) the compression cylinder 102 is standardized parts. So, for example, the barrel 110 of the air gun, the ammunition 112 of the air gun and all other air gun components that are forward of the compression cylinder 102 may be standardized parts. The ammunition may be, for example, BBs or pellets (such as airsoft plastic pellets).

The piston 204 includes a generally U-shaped piston body 206 having a forward portion 208 that is substantially parallel to a rearward portion 210. All or part of the forward portion 208 of the piston body 206 may be disposed within the interior bore 120 of the compression cylinder 102.

A sealing device 130 is disposed on the forward portion 208 of the piston body 206 proximate the distal end of the forward portion 208. The sealing device may be an O-ring seal, a parachute seal or the like, which is operable to provide a slidable air seal between the bore 120 of the compression cylinder 102 and the piston body 206 of the piston 204.

The piston 104 also includes one of a ferromagnetic section or a magnet 132 that is disposed on the rearward portion 210 of the piston body 206. The one of a ferromagnetic section or a magnet 132 may be either a ferromagnetic section 132A or a magnet 132B. In the case illustrated in FIGS. 10 and 11, the entire rearward portion 210 is a ferromagnetic section 132A. The drive coil assembly 106 is disposed over the ferromagnetic section 132A (i.e., the rearward section 210).

When the piston 204 is moved from the firing position 214 to the reset position 212, as illustrated in FIG. 10, air 136 is drawn into the cylinder bore 120 through the barrel 110 and transfer port 122 of the compression cylinder 102. When the drive coil assembly 106 is energized with a first polarity, the piston 204 is drawn from the reset position 212 (FIG. 10) to the firing position 214 (FIG. 11) relative to the compression cylinder 106 by the drive coil assembly 106 with increasing force.

More specifically, when the drive coil assembly 106 is energized, the ferromagnetic section 132A of the rearward portion 210 is simultaneously drawn toward the center of the drive coil assembly 106 and the piston 204 is drawn from the reset position 212 to the firing position 214 with a force provided by the drive coil assembly 106 that increases as the distance between the center of the drive coil assembly 106 and the ferromagnetic section 132A decreases. As the piston 204 is driven forward in the compression cylinder 104, the air 136 is compressed. Once the air pressure overcomes the frictional forces between the barrel 110 and projectile 112, and overcomes the inertia of the projectile 112, the projectile 112 will launch.

The increasing force applied by the drive coil assembly 106 to the piston 204 as the piston 204 moves from the reset position 212 to the firing position 214, advantageously enables a greater average force to be applied to driving the piston 204 forward than prior art launching systems. Additionally, because there is no storage of compression energy (such as when a metal spring or air spring is compressed and held for a fixed period of time), there is less heat loss associated with the launching system 200 compared to prior art launching system and, therefore, the launching system 200 is inherently more efficient than prior art launching systems.

In order to reset the piston 204 of launch system 200 (i.e., move the piston 204 from its firing position 214 to its reset position 212), a spring 216 is disposed on the distal end 218 of the rearward portion 210 of the piston body 206. When the drive coil assembly 106 is energized with its first polarity, the piston 204 is drawn from the reset position 212 to the firing position 214, which compresses the spring 216. When the drive coil assembly 106 is deenergized, the spring 216 is operable to extend, which drives the piston 204 from its firing position 214 to its reset position 212.

Though a spring 216 is used to reset the piston 204, other devices and systems may also be used. For example, the piston 204 may be reset by hand. Also, a permanent magnet 132B, rather than a ferromagnetic section 132A may be used instead. In that case, if the drive coil assembly 106 is energized in its second polarity, the drive coil assembly 106 will drive the permanent magnet 132B out of the drive coil assembly 106 and drive the piston 204 toward its reset position 212.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure not be limited to the described examples, but that it have the full scope defined by the language of the following claims.

What is claimed is:

1. A launching system for an air gun, the launching system comprising:

a compression cylinder comprising a cylinder body having an open rearward end and a closed forward end with an interior bore therebetween, the forward end having a transfer port configured for fluid communication with a barrel of an air gun;

a piston comprising:

a piston body having a forward portion disposed within the interior bore, a sealing device disposed on the forward portion of the piston body, and a permanent magnet disposed on a rearward portion of the piston body;

a drive coil assembly disposed over the permanent magnet; and a reset-push coil assembly disposed proximate the permanent magnet, when the piston is in the reset position;

wherein, when the drive coil assembly is energized with a first polarity, the piston is drawn from a reset position to a firing position relative to the compression cylinder by the drive coil assembly with increasing force;

wherein, when the reset-push coil assembly is energized with a first polarity, the permanent magnet is attracted to the reset-push coil assembly and the piston is drawn from the firing position to the reset position; and wherein, when the reset-push coil assembly is energized with a second polarity, the permanent magnet is repelled from the reset-push coil assembly and the piston is driven from the reset position to the firing position with a force that decreases as the distance between the reset-push coil assembly and permanent magnet increases.

2. The launching system of claim 1, comprising:

the permanent magnet is a rare earth permanent magnet.

3. The launching system of claim 1, comprising the reset-push coil assembly being operable to be energized with it second polarity and the drive coil assembly being operable to be simultaneously energized with its first polarity, such that:

the permanent magnet is repelled from the reset-push coil assembly and the piston is driven from the reset position to the firing position with a force provided by the reset-push coil assembly that decreases as the distance between the reset-push coil assembly and permanent magnet increases, and the permanent magnet is simultaneously drawn toward the center of the drive coil assembly and the piston is drawn from the reset position to the firing position with a force provided by the drive coil assembly that increases as the distance between the center of the drive coil assembly and the magnet decreases.

4. The launching system of claim 3, comprising the reset-push coil assembly being operable to be energized with its first polarity and the drive coil assembly being operable to simultaneously be deenergized, such that:

the permanent magnet is attracted to the reset-push coil assembly and the piston is drawn from the firing position to the reset position, and the drive coil assembly provides substantially zero force upon the permanent magnet as the piston is drawn from the firing position to the reset position.

5. The launching system of claim 1, comprising:

the piston body being generally U-shaped, wherein the forward portion of the piston body is substantially parallel to the rearward portion of the piston body.

6. The launching system of claim 4, comprising:

a spring is disposed on the distal end of the rearward portion of the piston body, wherein:

when the drive coil assembly is energized with its first polarity, the piston is drawn from the reset position to the firing position, which compresses the spring, and when the drive coil assembly is deenergized, the spring is operable to extend, which drives the piston from the firing position to the reset position.

7. The launching system of claim 4, comprising:

wherein, when the drive coil assembly is energized with its first polarity, the piston is drawn from the reset position to the firing position, and wherein, when the drive coil assembly is energized with a second polarity, the piston is driven from the firing position to the reset position.

8. A launching system for an air gun, comprising:

a compression cylinder comprising a cylinder body having an open rearward end and a closed forward end with an interior bore therebetween, the forward end having a transfer port configured for fluid communication with a barrel of an air gun;

a piston comprising:

a piston body having a forward portion disposed within the interior bore, a sealing device disposed on the forward portion of the piston body, and a permanent magnet disposed on a rearward portion of the piston body;

a drive coil assembly disposed over the permanent magnet; and a reset-push coil assembly disposed proximate the permanent magnet, when the piston is in the reset position;

wherein, when the drive coil assembly is energized with a first polarity, the piston is drawn from a reset position to a firing position relative to the compression cylinder by the drive coil assembly with increasing force; and wherein, when the reset-push coil assembly is energized with a second polarity, the permanent magnet is repelled from the reset-push coil assembly and the piston is driven from the reset position to the firing position with a force that decreases as the distance between the reset-push coil assembly and permanent magnet increases.

9. The launching system of claim 8, wherein the permanent magnet is a rare earth magnet.

10. The launching system of claim 8, comprising the reset-push coil assembly and drive coil assembly being operable to be simultaneously energized, such that:

the permanent magnet is repelled from the reset-push coil assembly and the piston is driven from the reset position to the firing position with a force provided by the reset-push coil assembly that decreases as the distance between the reset-push coil assembly and permanent magnet increases, and the permanent magnet is simultaneously drawn toward the center of the drive coil assembly and the piston is drawn from the reset position to the firing position with a force provided by the drive coil assembly that increases as the distance between the center of the drive coil assembly and the permanent magnet decreases.

11. The launching system of claim 10, comprising the reset-push coil assembly being operable to be energized with a first polarity and the drive coil assembly being operable to simultaneously be deenergized, such that:

the permanent magnet is attracted to the reset-push coil assembly and the piston is drawn from the firing position to the reset position, and the drive coil assembly provides substantially zero force upon the permanent magnet as the piston is drawn from the firing position to the reset position.

12. The launching system of claim 8, wherein the compression cylinder body comprises a non-ferrous metal.

13. The launching system of claim 8, wherein the drive coil assembly comprises:

a non-magnetic spool having a spool bore configured to receive the permanent magnet therethrough; and wire coil wrapped around the non-magnetic spool of the drive coil assembly.

14. The launching system of claim 8, wherein the reset-push coil assembly comprises:

a ferromagnetic core; and a wire coil wrapped around the core of the reset-push coil assembly.

15. The launching system of claim 14, comprising:

a reset-push spool disposed over the ferromagnetic core, wherein the wire coil of the reset-push coil assembly is wrapped around the reset-push spool.

16. A launching system for an air gun, the launching system comprising:

a compression cylinder comprising a cylinder body having an open rearward end and a closed forward end with an interior bore therebetween, the forward end having a transfer port configured for fluid communication with a barrel of an air gun;

a piston comprising:

a generally U-shaped piston body having a forward portion that is substantially parallel to a rearward portion, the forward portion being disposed within the interior bore, a sealing device disposed on the forward portion of the piston body, and a ferromagnetic section disposed on the rearward portion of the piston body; and a drive coil assembly disposed over the ferromagnetic section;

wherein, when the drive coil assembly is energized with a first polarity, the piston is drawn from a reset position to a firing position relative to the compression cylinder by the drive coil assembly with increasing force.

17. The launching system of claim 16, comprising:

a spring is disposed on the distal end of the rearward portion of the piston body, wherein:

when the drive coil assembly is energized with its first polarity, the piston is drawn from the reset position to the firing position, which compresses the spring, and when the drive coil assembly is deenergized, the spring is operable to extend, which drives the piston from its firing position to its reset position.

* * * * *